United States Patent [19]

Schroeder

[11] 4,019,932

[45] Apr. 26, 1977

[54] INCENDIARY COMPOSITION

[75] Inventor: Fred Schroeder, Lakeview Terrace, Calif.

[73] Assignee: Dow Corning Corporation, Midland, Mich.

[22] Filed: Apr. 14, 1976

[21] Appl. No.: 676,826

Related U.S. Application Data

[63] Continuation of Ser. No. 487,474, July 11, 1974, abandoned.

[52] U.S. Cl. ..... 149/19.1; 149/19.2; 149/19.3; 149/37

[51] Int. Cl.² ..... C06B 45/10; C06B 33/00

[58] Field of Search ..... 149/19.1, 19.2, 19.3, 149/37

[56] References Cited

UNITED STATES PATENTS

| | | | |
|---|---|---|---|
| 2,949,352 | 8/1960 | Cramer | 149/19.2 |
| 3,137,599 | 6/1964 | Alsgaard | 149/19.2 |
| 3,325,316 | 6/1967 | MacDonald | 149/37 |
| 3,391,221 | 7/1968 | Gore | 260/824 R |
| 3,565,706 | 2/1971 | Waite | 149/19.3 |
| 3,669,020 | 6/1972 | Waite | 149/19.3 |
| 3,695,951 | 10/1972 | Helms | 149/37 |

*Primary Examiner*—Stephen C. Bentley
*Assistant Examiner*—Donald P. Walsh
*Attorney, Agent, or Firm*—Howard W. Hermann

[57] ABSTRACT

There is described an incendiary composition consisting essentially of by weight 20–40 percent magnesium powder, 30–60 percent metallic oxide and the remainder of elastomeric polysiloxane which serves as a binder the amount of polysiloxane being at least 10 percent. A second type of composition consists of 20–50 percent magnesium powder, 20–30 percent polytetrafluoroethylene in particulate form, and the remainder of elastomeric polysiloxane. A third type of composition consists of mixtures of the first and second types in proportions according to the desired specific gravity of the incendiary.

6 Claims, No Drawings

INCENDIARY COMPOSITION

This is a continuation, of application Ser. No. 487,474, filed July 11, 1974, now abandoned.

BACKGROUND OF THE INVENTION

The present invention relates to incendiary compositions and more particularly to incendiary compositions which are designed for the ignition of ambient combustible materials upon delivery by detonation of an explosive charge.

Incendiary compositions for ignition of combustible materials have both military use in the destruction of property and war material, and civilian application in the starting of backfires for forest fire control, for example. Several types of incendiary compositions of the general type contemplated by the present invention have been used in the past. Such compositions are incorporated in devices in which an explosive charge either carries the incendiary material to its intended place of use or disperses the incendiary material in a more or less random fashion from the point of detonation of the explosive charge. One common type has used a flowing, powdery mixture of metal and oxidizer or pressed pellets of such powders, which are dispersed upon explosion of an explosive charge. Such devices, of course, inherently have an obvious hazard insofar as handling is concerned because materials are spontaneously reactable. Further, they are not totally satisfactory because the powders tend to burn too rapidly and the explosive charge tends to disperse the powders in an erratic manner and over a very short range before burn-out occurs or causes them to detonate upon application of pressure from the explosive charge. Thus, neither uniformity nor extent of distribution is often optimum.

Other types of known compositions make use of solid compositions such as zirconium-misch metal or Thermits. These materials can be cast into a proper form such as the lining of a shell casing which is then filled with the explosive charge. They tend to suffer, however, from handling difficulties due to vacuums and pressures needed for fabrication and also to early burn-out due to their brittleness and complete disintegration upon being subjected to the extremely high pressures inherent in the high explosive detonation. The disintegration of course results in failure to ignite ambient combustible material. Further, most of these materials are subject to quenching by water and other liquids and will not ignite wet materials which would otherwise be combustible, nor are they useable at high altitudes due to need for oxygen.

A particular type of composition which has been used in the past makes use of magnesium powder with a strong oxidizing agent such as polytetrafluoroethylene or salt type oxidizers such as potassium perchlorate. These materials are extremely hazardous to handle from the standpoint that atmospheric moisture will often cause spontaneous ignition. In the case of magnesium and polytetrafluoroethylene, a solvent compounding method is often used as a safety precaution. However, upon removal of the solvent which adds an extra processing step, a danger exists that atmospheric moisture will inherently enter the material even though precautions are taken to lower ambient humidity. It has also been suggested in the past that inert ingredients can be admixed with the incendiary materials and remain as part of the composition to lessen the opportunity for spontaneous discharge. In the past, however, these expedients have generally caused a reduction in the effectiveness of the incendiary nature of the composition and have not been entirely satisfactory. Furthermore, these materials also are often completely disintegrated or will themselves be detonated by the high explosive detonation.

It has in the past been suggested that silicone materials can be used in flare compositions as a binder. Generally the maximum amount of binder used was in the range of 4–5 percent by weight of the composition, because it was felt that binder merely held the active ingredients together and detracted from the brilliance of the composition. Since no detonation was involved resistance to detonation in the binder material was necessary only to the extent that the material should not detonate upon burning at close to atmospheric pressure. These same flare compositions would detonate if subjected to the pressures of a high explosive charge detonation inside a casing in which they were contained. It has also been found that silicone rubber compositions including magnesium and salt type oxidizers such as potassium perchlorate are subject to detonation.

SUMMARY OF THE PRESENT INVENTION

It is accordingly an object of the present invention to provide an improved incendiary composition for delivery by use of high explosives and which is readily handled with complete safety and can be ignited and used with undiminished effectiveness. The material was to be free of a tendency to detonate upon explosion of a high explosive charge in contact therewith and to act as a resilient cushion between particles whereby shattering into minute particles would be prevented. Further, the composition which is designed for use with a high explosive for dispersion and ignition of the material can be tailored, for example, to match the specific gravity of the high explosive which is being utilized and thereby avoid any problems which could be encountered by off-center loading of the incendiary in a high explosive projectile or tailored to provide the desired weight of a bomb to match calculated trajectories. In general terms the composition of the present invention consists essentially of magnesium powder, an oxidizer which may be a metallic oxide and/or polytetrafluoroethylene, and a silicone rubber binder (elastomeric polysiloxane) which serves to isolate the magnesium particles from the oxidizer particles, and also serves to cushion the composition to allow rough handling without detonation or spontaneous ignition, or shattering upon being subjected to a detonation in proximity thereto. Further, the polysiloxane is believed to add oxygen to aid in burning and upon burning serves to bind the ash to provide a wicking action for ambient liquid combustibles such as diesel oil, for example. The material can be molded, extruded, or rolled into sheets as desired in comparative safety.

DESCRIPTION OF PREFERRED EMBODIMENTS

The invention will become better understood to those skilled in the art by reading the following detailed description of preferred embodiments and the examples of specific compositions provided therein.

In general, the incendiary compositions of the present invention can be divided into three types. The first uses a metallic oxide as an oxidizer for the magnesium powder, the second uses powdered polytetrafluoroethylene as an oxidizer, and the third is a mixture of the first and second types which is to be used generally to provide a particular specific gravity which may be desired, for example, to match the specific gravity of the particular high explosive composition utilized in the projectile in which the incendiary is to be carried thereby preventing any possibility of off-center loading of the projectile and consequent inaccuracy in its trajectory or to match the calculated weight of a bomb load to provide trajectory presupposed in bomb sights or like aiming devices. In all cases the oxidizer and magnesium powder are held together by an elastomeric polysiloxane binder which serves as a processing aid to avoid hazards in manufacture, allows molding, extruding, or rolling of any desired shape, serves to cushion and isolate the magnesium powder and oxidizer until burning is desired, and, it is believed, also serves to supply oxygen to enhance the burning of the composition.

The polysiloxanes utilized herewith are those having a polymer backbone of alternating silicon and oxygen atoms with pendent hydrocarbon groups on the silicon atoms. Such compositions are lightly crosslinked to form elastomeric materials and many such materials are commercially available as liquids curable to silicone rubbers. Some types are commonly known as room temperature vulcanizing silicone rubbers and other require application of heat to activate a vulcanizing agent to enhance curing. The pendent hydrocarbon groups on the silicon atoms in such materials are predominately methyl groups but some phenyl or vinyl groups are often included. The precise composition of such materials is not critical to the present invention since the material serves only as an isolation mechanism, cushion, and, it is believed, an oxygen supply for the magnesium and oxidizer.

The magnesium powder is preferably of the ground type rather than spherical powder because the ground material has more sharp edges and presents a greater surface area for ease in ignition. It is preferred that the magnesium powder be of 30 U.S. Standard screen mesh size or smaller. Mixed sizes can be used. In the case of a metal oxide type of oxidizer the group of oxides consisting of $Fe_3O_4$, $MnO_2$, and $TiO_2$ are satisfactory. The polytetrafluoroethylene should be in particulate form and for this purpose commercially available polytetrafluoroethylene molding powder has been found to be most satisfactory.

The first type of composition in its preferred form consists essentially of by weight 20–40 percent magnesium powder, 30–60 percent metallic oxide, and the remainder of elastomeric polysiloxane, the minimum amount of the polysiloxane being 10 percent. The second group in its preferred form consists essentially of 20–50 percent magnesium powder, 20–30 percent polytetrafluoroethylene, and the remainder of elastomeric polysiloxane again in amounts of at least 10 percent. In all instances percentages are weight percents.

In manufacture the magnesium is first wet with the curable polysiloxane liquid and then the oxidizing agent is added. If catalyst is needed for the curing of polysiloxane it is preferred that it be added just prior to forming the material into its desired shape. However, it can be added to the polysiloxane liquid prior to adding the magnesium if so desired. After thorough mixing the composition is molded, extruded, or rolled into its desired configuration for placement in contact with the high explosive or alternatively, may be poured into a hollow in the high explosive. It is to be noted that for safe compounding of the incendiary material, particularly in the case of the polytetrafluoroethylene, the magnesium must be thoroughly wet by the liquid polysiloxane prior to addition of the oxidizer. Otherwise, there is danger of spontaneous ignition or detonation during compounding. The polysiloxane, however, serves to isolate the magnesium particles and although the composition is still match-sensitive the extreme hazard is eliminated by this precaution. There is no danger of detonation during molding or after the material is cured.

It should be noted that the metallic oxides in the compositions using them are quite heavy relative to the weight of the polytetrafluoroethylene in the alternative compositions. Therefore, by mixing the first and second types of compositions a fairly wide range of specific gravities is possible in order to match, for example, the specific gravity of the high explosive composition in the particular device in which the incendiary material is to be used. Varying the specific gravity also has application where the incendiary material is substituted for part of the high explosive in articles such as bombs. Automatic aiming equipment such as bomb sights do not have to be adjusted for different weight projectiles under such circumstances. If the specific gravity is matched there is no problem of off-center loading of the incendiary material in projectiles or weight differential between incendiary and high explosive type projectiles, and the trajectory of the projectile will remain true.

The materials as defined have sufficient strength and resilience to withstand detonation, or pulverizing upon being subjected to nearby detonation as many prior art materials do. Although the materials break up, the pieces are large enough to sustain burning. Ignition takes place automatically by the detonation of the high explosive in which the materials are imbedded or placed in proximity to.

A specific example of the first type of incendiary composition consists essentially by weight of 25% ground magnesium powder of 320 U.S. Standard screen mesh size, 50% $Fe_3O_4$, and 25% room temperature vulcanizing silicone rubber commercially available under the designation of Dow Corning 3110 RTV encapsulant. A specific example of the second type of material consists essentially of 37% by weight of ground magnesium of 320 U.S. Standard screen mesh size, 26% polytetrafluoroethylene available commercially as duPont Teflon Type 7A, and 37% room temperature vulcanizing silicone rubber available commercially under the designation Dow Corning 3110 RTV encapsulant. The composition of a particular mixture of the first and second types consisted essentially of by weight about 36% ground magnesium of 320 U.S. Standard screen mesh size, 25% $Fe_3O_4$, 9% polytetrafluoroethylene molding powder (duPont Teflon Type 7A) and 30% room temperature vulcanizing silicone rubber (Dow Corning 3110 RTV encapsulant).

Various modifications of the invention described herein will become obvious to those skilled in the art from a reading of the foregoing. It is, therefore, to be understood that within the scope of the appended claims the invention may be practiced otherwise than as specifically described.

That which is claimed is:

1. In combination with an explosive charge an incendiary composition consisting essentially of by weight 20 to 40 percent magnesium powder, 30 to 60 percent metallic oxide chosen from the group consisting of $Fe_3O_4$, $MnO_2$ and $TiO_2$ and the remainder of elastomeric polysiloxane, said remainder being at least 10 percent.

2. The combination defined in claim 1 wherein said composition consists essentially of by weight about 25 percent ground magnesium powder of 320 U.S. Standard screen mesh size, 50 percent $Fe_3O_4$ and 25 percent room temperature vulcanizing silicone rubber as a binder.

3. In combination with an explosive charge an incendiary composition consisting essentially of by weight 20 to 50 percent magnesium powder, 20 to 30 percent polytetrafluoroethylene in particulate form and the remainder of elastomeric polysiloxane as a binder for said magnesium and polytetrafluoroethylene, said remainder being at least 10 percent.

4. The combination defined in claim 3 wherein said composition consists essentially of by weight about 37 percent ground magnesium of 320 U.S. Standard screen mesh size, 26 percent polytetrafluoroethylene molding powder, and 37 percent room temperature vulcanizing silicone rubber.

5. In combination with an explosive charge an incendiary composition consisting essentially of a mixture of the composition described in claim 3 together with a composition consisting essentially by weight of 20 to 40 percent magnesium powder, 30 to 60 percent metallic oxide chosen from the group consisting of $Fe_3O_4$, $MnO_2$ and $TiO_2$ and the remainder of elastomeric polysiloxane, said remainder being at least 10 percent.

6. The combination defined in claim 5 in which said incendiary composition consists essentially of by weight about 36 percent ground magnesium of 320 U.S. Standard screen mesh size, 25 percent $Fe_3O_4$, 9 percent polytetrafluoroethylene molding powder and 30 percent room temperature vulcanizing silicone rubber.

* * * * *